US007918408B2

(12) United States Patent
Tshieh

(10) Patent No.: US 7,918,408 B2
(45) Date of Patent: Apr. 5, 2011

(54) HAND-HELD SHOWERHEAD STRUCTURE

(75) Inventor: Ching-Chen Tshieh, Taiwan (TW)

(73) Assignee: Globe Union Industrial Corp., Taichung (TW)

( * ) Notice: Subject to any disclaimer, the term of this patent is extended or adjusted under 35 U.S.C. 154(b) by 483 days.

(21) Appl. No.: 12/191,726

(22) Filed: Aug. 14, 2008

(65) Prior Publication Data

US 2010/0038454 A1 Feb. 18, 2010

(51) Int. Cl.
*A62C 31/00* (2006.01)

(52) U.S. Cl. ..... 239/444; 239/446; 239/447; 239/449; 239/530; 239/552; 239/558; 239/581.1

(58) Field of Classification Search ..... 239/444, 239/446–449, 443, 548, 552, 558, 556, 560, 239/561, 581.1, 525, 530
See application file for complete search history.

(56) References Cited

U.S. PATENT DOCUMENTS

| | | | | |
|---|---|---|---|---|
| 5,476,225 | A * | 12/1995 | Chan | 239/449 |
| 5,697,557 | A * | 12/1997 | Blessing et al. | 239/447 |
| 7,100,845 | B1 * | 9/2006 | Hsieh | 239/447 |
| 7,111,795 | B2 * | 9/2006 | Thong | 239/443 |
| 7,520,448 | B2 * | 4/2009 | Luettgen et al. | 239/444 |
| 7,740,186 | B2 * | 6/2010 | Macan et al. | 239/446 |

* cited by examiner

*Primary Examiner* — Steven J Ganey
(74) *Attorney, Agent, or Firm* — Tim Tingkang Xia; Morris, Manning & Martin, LLP

(57) ABSTRACT

A hand-held showerhead structure includes a handle portion, a water-outlet base, and a rotary member. The rotary member includes an outlet valve and is mounted on the water-outlet base in a rotationally adjustable manner, which is turned by a user to adjust to a desired water-spraying mode. A plurality of annular chambers is defined between a middle cover and a lower cover of the outlet valve. A plurality of arc-shaped flow-guide ribs distributed radially and separated from one another is protruded from a top wall of the lower cover opposing to an annular chamber in an outer peripheral area. A plurality of open-ended arc-shaped flow-guide channels is accordingly defined between the flow-guide ribs. Moreover, a plurality of outlet holes is arranged in flow-guiding directions of the flow-guide channels. Therefore, the showerhead positioned in such a water-spraying mode is capable of achieving a uniform water-spraying effect at a larger spraying area.

12 Claims, 14 Drawing Sheets

HAND-HELD SHOWERHEAD STRUCTURE

BACKGROUND OF THE INVENTION

1. Field of the Invention

The present invention relates to a showerhead structure, and more particularly to a hand-held showerhead structure suitable for being adjusted among a plurality of stages and capable of achieving a uniform water spray at a large spraying area in one water-outlet mode.

2. Related Art

Currently, a hand-held showerhead structure, especially the hand-held showerhead structure with a multi-stage or multi-mode adjustment function for adjusting water-spraying modes, substantially always includes a handle portion, a water-outlet base, and a rotary member. The handle portion is mainly provided for a user to hold and guides a water flow from a water inlet end to a water outlet end. The water-outlet base is mounted and fixed at the water outlet end of the handle portion and is communicated with the water outlet end, so as to utilize the twists and turns of flow channels therein to guide the water flow to move downward. The rotary member is movably fastened on the water-outlet base for the user to rotationally adjust to a desired water-spraying mode. The rotary member further includes an outlet valve, an operation frame, and a face cover portion. The outlet valve is formed by an upper cover, a middle cover, and a lower cover connected to one another. A plurality of chambers is defined between the upper cover, the middle cover, and the lower cover. A plurality of holes is provided at predetermined positions of the upper cover, the middle cover, and the lower cover. When the user turns to adjust the rotary member to make the predetermined holes of the upper cover be aligned with the water flow of the water-outlet base, the water flow from the water-outlet base is guided to the holes corresponding to the lower cover through the corresponding chambers there-between, so as to achieve a predetermined water-spraying effect.

It should be particularly noted that, the showerhead structure further has a radial-shaped partition 1*a* protruded oppositely from outer peripheral areas of a top wall of the lower cover 1 and a bottom wall of the middle cover, as shown in FIG. 1, so as to define a chamber. Through the radial-shaped chamber, the water flow can be radially guided and then sprayed out. However, the radial-shaped partition 1*a* of the radial-shaped chamber is a continuous closed wall. When the water flow enters the chamber, it is guided to end portions 1*b* of the radial-shaped chamber by the closed wall, such that most of the water flow is concentrated in the end portions 1*b* and then sprayed out via holes 1*c* at the end portions 1*b*. Therefore, since the radial-shaped partition 1*a* in the form of a continuous closed wall greatly limits the water-spraying area generated by such a water-spraying mode, and most of the water is sprayed out via the holes 1*c* at the end portions 1*b* in an excessively concentrated manner, the water-spraying mode cannot achieve a uniform water-spraying effect at a large area and thus cannot meet the requirements of specific customers.

In addition, in the showerhead structure, a resilient positioning block disposed at a bottom end of the water-outlet base is resiliently snapped with a positioning hole oppositely provided on a top wall of the upper cover, so as to allow the user to rotate and position the rotary member to the desired water-spraying mode. However, the resilient positioning block and the positioning hole are snapped and positioned along a direction of the water flow from the water-outlet base. Therefore, when the hand-held showerhead is in a spraying state, since a part of the pressure of the water flow from the water-outlet base generates a departing thrust force between the water-outlet base and the upper cover, the snapping and positioning effect between the resilient positioning block and the positioning hole is affected. In this case, the user often cannot adjust the rotary member to the desired water-spraying mode accurately.

SUMMARY OF THE INVENTION

Accordingly, the present invention is directed to a hand-held showerhead structure, which can be rotationally adjusted properly, so as to achieve a uniform water-spraying effect at a large spraying area in one water-spray mode.

The present invention is also directed to a hand-held showerhead structure, in which the showerhead structure can be rotationally positioned to a proper mode explicitly even in a spraying state, so as to allow a user to rotationally adjust to a desired water-spraying mode accurately.

The present invention is further directed to a hand-held showerhead structure, in which tightly-bonded upper anti-slip ribs and lower anti-slip ribs are provided at a handle portion for the user to hold firmly, so as to avoid a slipping phenomenon.

In order to achieve the above objectives, a hand-held showerhead structure is provided in the present invention, which includes a handle portion, a water-outlet base, and a rotary member.

The handle portion has a water inlet end and a water outlet end, for guiding a water flow from the water inlet end to the water outlet end.

The water-outlet base is mounted and fixed at the water outlet end of the handle portion, for guiding and changing a direction of the water flow.

The rotary member at least includes an outlet valve. The outlet valve is formed by an upper cover, a middle cover, and a lower cover firmly joined to one another. A plurality of grid-shaped chambers is defined between the upper cover and the middle cover. A plurality of annular chambers is defined between the middle cover and the lower cover. A plurality of holes is respectively provided at predetermined positions of the upper cover, the middle cover, and the lower cover, and is communicated with the chambers. The upper cover is movably fastened on the water-outlet base, so as to be rotated together with the middle cover and the lower cover on the water-outlet base. Meanwhile, the water flow from the water-outlet base sequentially passes through the predetermined holes of the upper cover, the predetermined chambers between the upper cover and the middle cover, the predetermined holes of the middle cover, the predetermined chambers between the middle cover and the lower cover, and the predetermined holes of the lower cover, and then is sprayed out into a predetermined water-spraying mode.

A plurality of arc-shaped flow-guide ribs distributed radially and separated from one another is protruded from a top wall of the lower cover opposing to an annular chamber close to the outer peripheral area, an open-ended arc-shaped flow-guide channel is defined between any two adjacent flow-guide ribs, and the holes on the lower cover are sequentially arranged and distributed along flow-guiding directions of the flow-guide channels respectively.

The upper cover of the hand-held showerhead structure is provided with a positioning tooth protruded from a top wall thereof. The water-outlet base is provided with an inner annular wall at a bottom portion thereof. The inner annular wall is provided with a plurality of positioning tooth slots for being properly engaged with the positioning tooth, so as to allow the rotary member to be rotationally adjusted and positioned.

The handle portion of the hand-held showerhead structure further includes a handle body, a pipe fitting, an upper anti-slip plate, a lower anti-slip plate, and an upper handle cover. The handle body is provided with the water outlet end and integrally formed with a lower handle cover extended from the water inlet end. An accommodating groove is provided above the lower handle cover for the pipe fitting to be mounted therein. The upper handle cover is used to cover the accommodating groove. The upper anti-slip plate is clamped between the upper handle cover and the pipe fitting and is properly protruded from the upper handle cover, so as to form an upper anti-slip rib. The lower anti-slip plate is clamped between the pipe fitting and the lower handle cover and is properly protruded from the lower handle cover, so as to form a lower anti-slip rib.

With the hand-held showerhead structure of the present invention, the water flow can be guided through the radially-distributed arc-shaped flow-guide ribs and the flow-guide channels on the top wall of the lower cover, and the flow-guide channels in the open-ended form do not block or restrict the path of the water flow and further enable a portion of the water flow to flow among the flow-guide channels and evenly distributed within the flow-guide channels, so that a uniform water-spraying effect at a large area is achieved after the water flow that enters the chamber is sprayed out via the holes opposite to the lower cover. Moreover, the positioning tooth slots on the inner annular wall of the water-outlet base and the positioning tooth on the top wall of the upper cover are engaged and positioned in a circumferential direction, which is not affected by the departing effect between the water-outlet base and the top wall. Therefore, the rotary member still has an explicit rotationally positioning effect even when the showerhead structure is in a spraying state, which facilitates the user to correctly adjust to a desired water-spraying mode. In addition, since the upper anti-slip plate and the lower anti-slip plate are provided at the handle portion and respectively tightly clamped between the upper handle cover and the pipe fitting and between the pipe fitting and the lower handle cover after being assembled, they are tightly bonded to the handle portion, so as to provide an anti-slipping function, which thus is helpful for the user to hold firmly to avoid a slipping phenomenon.

BRIEF DESCRIPTION OF THE DRAWINGS

The present invention will become more fully understood from the detailed description given herein below for illustration only, and thus is not limitative of the present invention, and wherein.

DETAILED DESCRIPTION OF THE INVENTION

Figure 1:
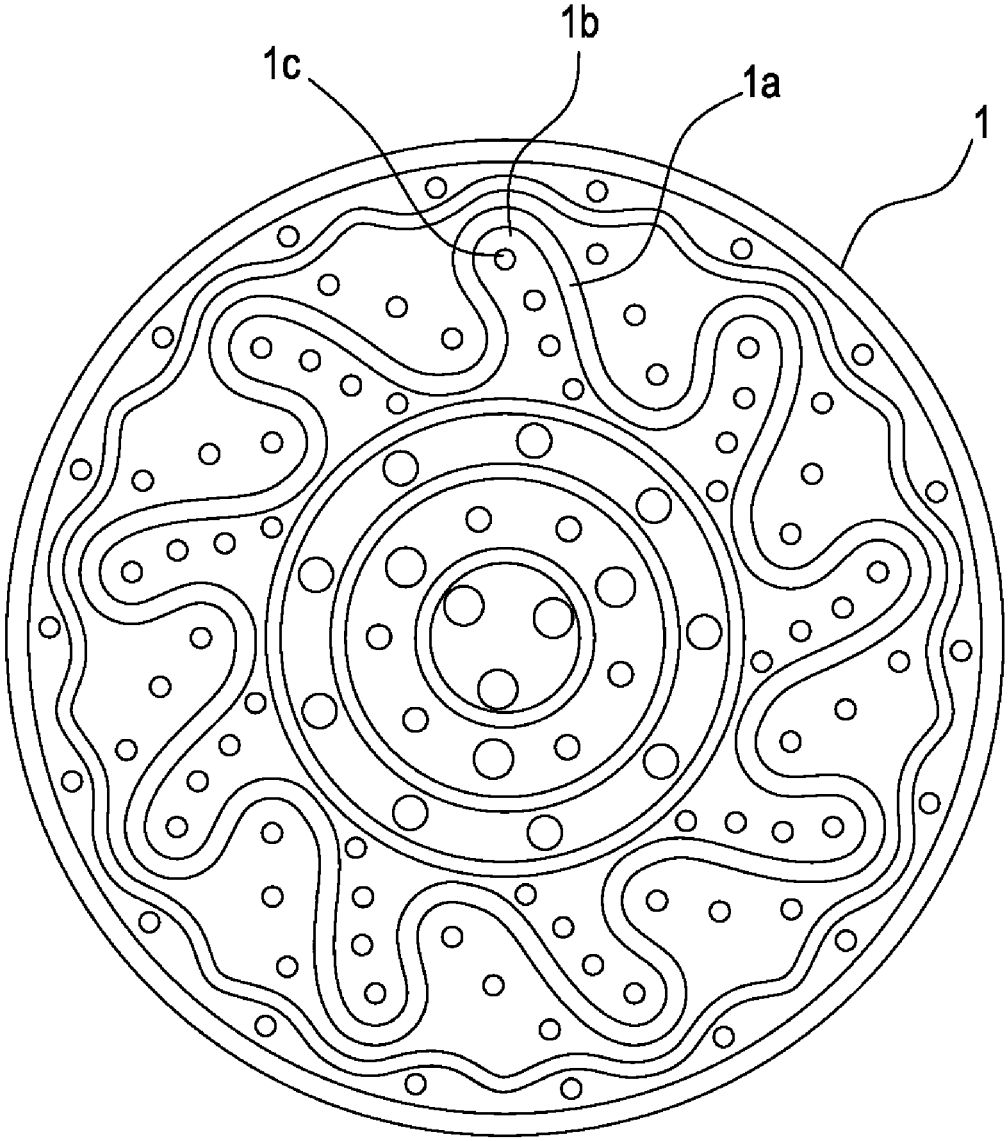
FIG. 1 (prior art)
FIG. 1 is a plan view of a top portion of a lower cover in a hand-held showerhead structure in the prior art.
Figure 2:
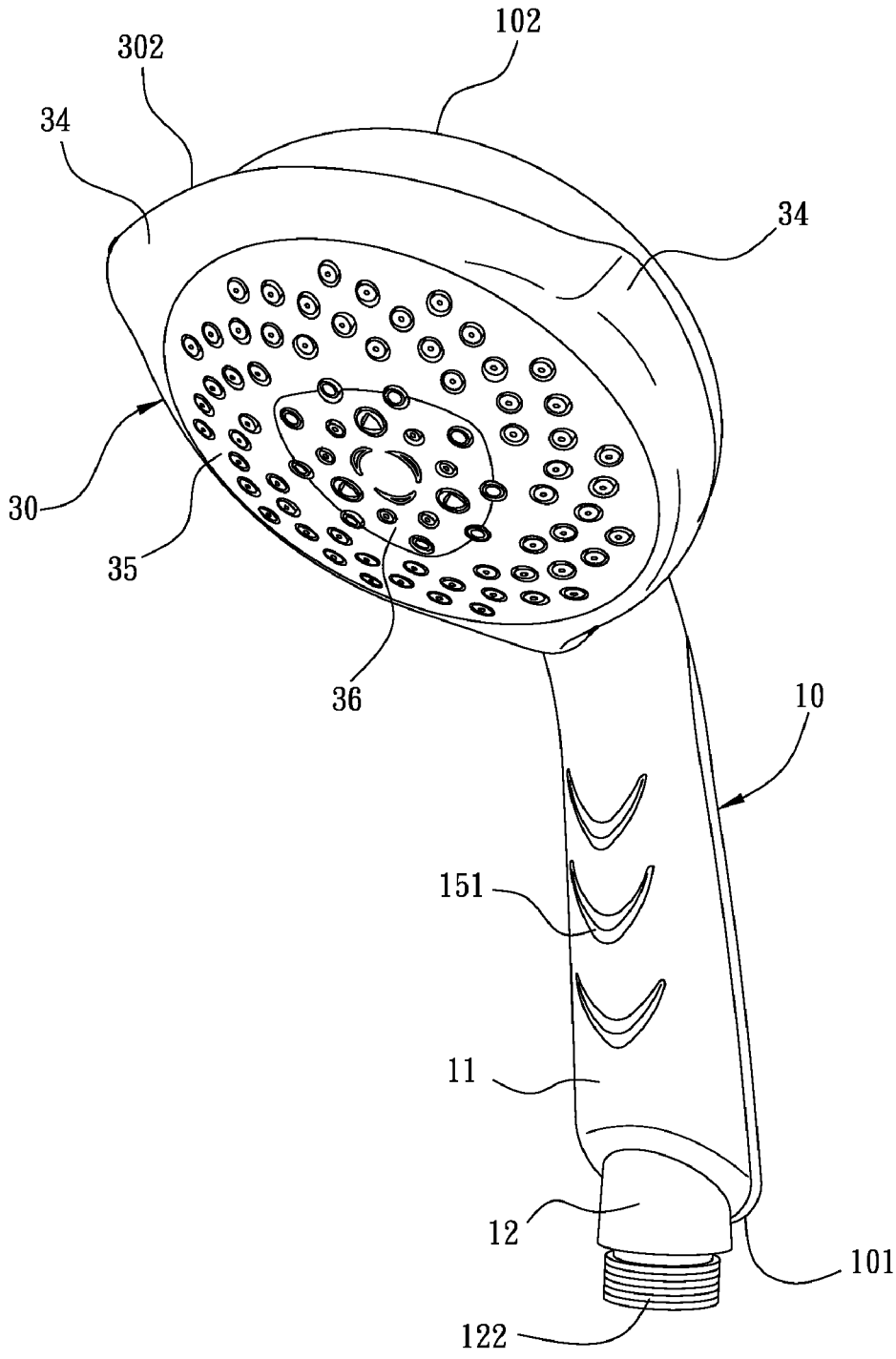
FIG. 2 is an assembled view of an appearance of a hand-held showerhead structure according to the present invention.
Figure 3:
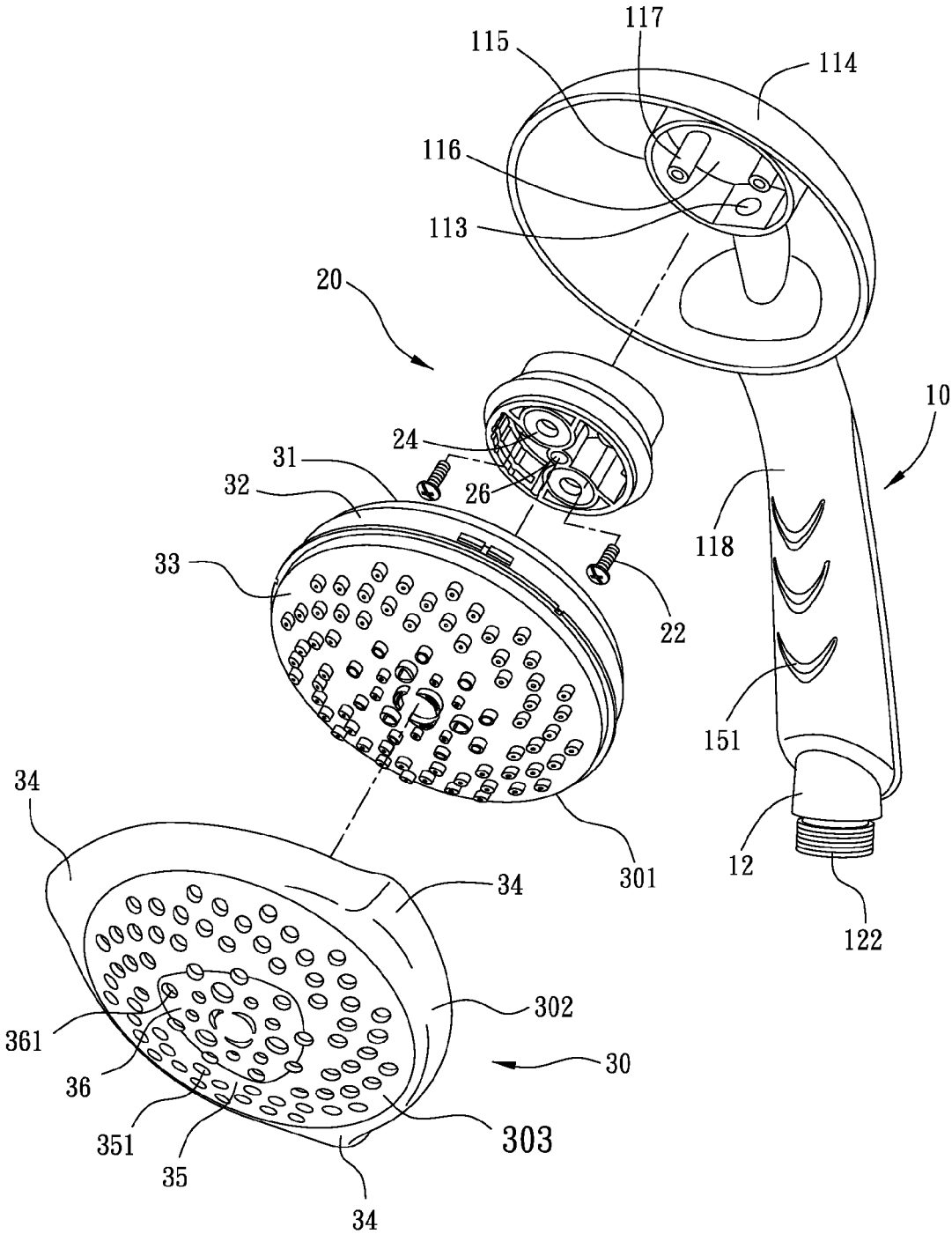
FIG. 3 is an exploded stereogram of general parts of a hand-held showerhead structure according to the present invention.
Figure 4:
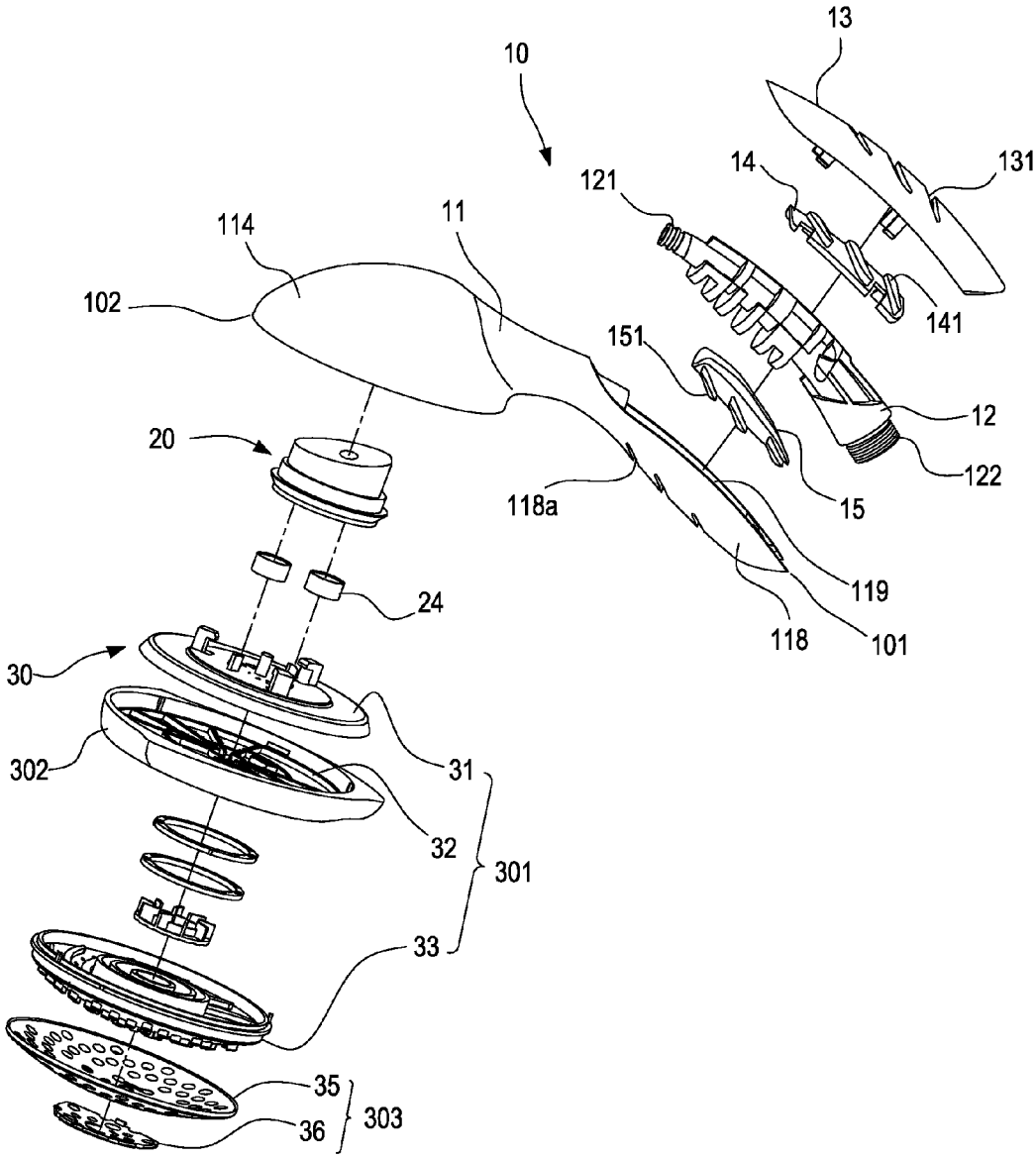
FIG. 4 is an exploded stereogram of detail parts of a hand-held showerhead structure according to the present invention.

FIGS. 2 to 15 are schematic views of a structure according to a preferred embodiment of the present invention. The illustrations are mainly given below with reference to FIGS. 2 to 5, in which the structure is illustrated below in detail with reference to FIGS. 6 to 15.

A hand-held showerhead structure according to a preferred embodiment of the present invention has approximately the same structure as that in the prior art, which mainly includes a handle portion 10, a water-outlet base 20, and a rotary member 30.

The handle portion 10 includes a water inlet end 101 and a water outlet end 102, for guiding a water flow from the water inlet end 101 to the water outlet end 102. The handle portion 10 according to this embodiment mainly includes a handle body 11, a pipe fitting 12, an upper handle cover 13, an upper anti-slip plate 14, and a lower anti-slip plate 15.

The handle body 11 is a main configuration of the handle portion 10, and is integrally formed with a water flow channel 111, as well as a pipe connection hole 112 and a water outlet hole 113 respectively positioned at two ends of the water flow channel 111. One end of the handle body 11 is formed into the water outlet end 102. An approximately bowl-shaped cover cap 114 is formed on the water outlet end 102. An inner wall of the cover cap 114 is integrally extended with an annular wall 115, so as to define an accommodating space 116. Two tube pillars 117 are protruded out of the accommodating space 116 and communicated with the water outlet hole 113. The handle body 11 is integrally extended with a lower handle cover 118 opposing to the water inlet end 101 of the handle portion 10. An accommodating groove 19 is formed above the lower handle cover 118. A plurality of arc-shaped through-grooves 118*a* is formed on a bottom wall of the accommodating groove 119.

The pipe fitting 12 is made of a plastic material and is accommodated and secured in the accommodating groove 119 above the lower handle cover 118 of the handle body 11. A front end and a rear end of the pipe fitting 12 are respectively formed with a water outlet joint 121 and a water inlet joint 122. The water outlet joint 121 can be inserted into and fixed with the pipe connection hole 112 of the handle body 11. The water inlet joint 122 is connected to a connection pipe (not shown).

The upper handle cover 13 is configured like a cover and made of a rigid plastic material, which can be fastened above the pipe fitting 12 and has a profile approximately consistent with that of the lower handle cover 118 of the handle body 11. Therefore, the upper handle cover 13 and the lower handle cover 118 can be enclosed with each other to form a rod-shaped structure, which is provided for the user to hold with hands and accommodates the pipe fitting 12 therein. In addition, a plurality of arc-shaped through-grooves 131 is formed on an upper wall of the upper handle cover 13.

The upper anti-slip plate 14 is configured as a plate and made of a soft plastic material, which can be clamped and padded between the upper handle cover 13 and the pipe fitting 12. A plurality of arc-shaped anti-slip ribs 141 is integrally formed on an outer arc-shaped surface of the upper anti-slip plate 14, which can be protruded out of the opposing through-grooves 131 on the upper handle cover 13, thereby providing an anti-slip effect when being held with hands.

The lower anti-slip plate 15 is configured as a plate and made from a soft plastic material, which can be clamped and padded between the pipe fitting 12 and the lower handle cover 118. A plurality of arc-shaped anti-slip ribs 151 is integrally formed on an outer arc-shaped surface of the lower anti-slip plate 15, which can be protruded out of the opposing through-grooves 118*a* on the lower handle cover 118, thereby providing an anti-slip effect when being held with hands.

The water-outlet base 20 is mounted and fixed at the water outlet end 102 of the handle portion 10 for guiding and changing a direction of the water flow. The water-outlet base 20 in this embodiment is cylindrical-shaped and thus can be accommodated in the accommodating space 116 of the handle body 11. The water-outlet base 20 is provided with two through-holes 21 in a longitudinal direction. The through-holes 21 are respectively penetrated into the opposing tube pillars 117 in the accommodating space 116, and are respectively secured by a securing bolt 22 and the tube pillars 117.

Figure 6:
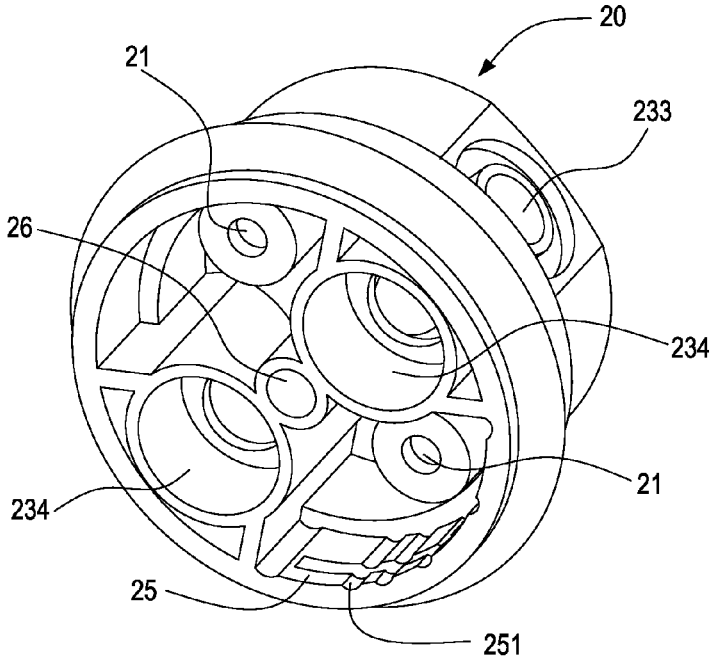
FIG. 6 is a stereogram of an appearance of a bottom portion of a water-outlet base according to the present invention.
Figure 7:
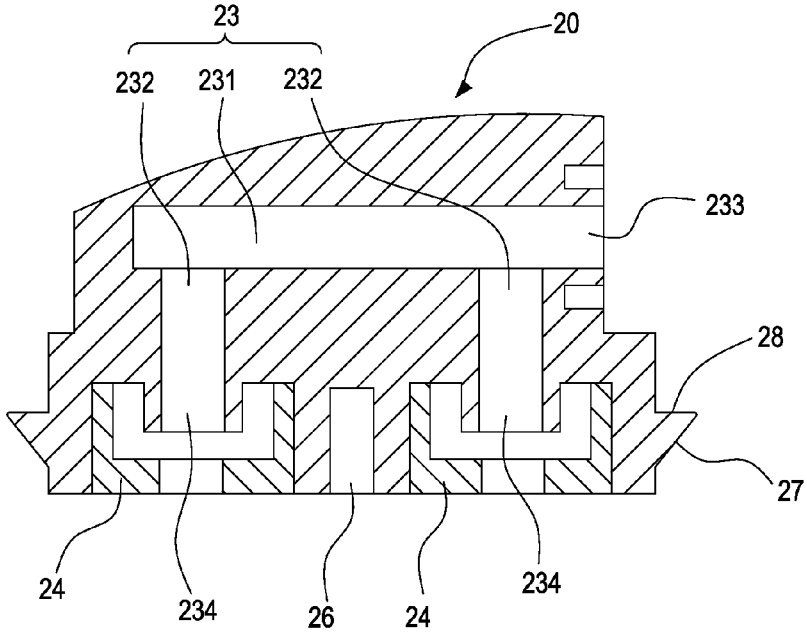
FIG. 7 is a cross-sectional side view of a water-outlet base according to the present invention.

Referring to FIGS. 6 and 7, the water-outlet base 20 is further formed with a water flow channel 23 therein. The water flow channel 23 is constituted by one lateral flow channel 231 and two longitudinal flow channels 232 that are communicated with each other. The lateral flow channel 231 is formed with a water inlet hole 233 on an outer peripheral wall of the water-outlet base 20. The water inlet hole 233 is closely communicated with the water outlet hole 113 in communication with the accommodating space 116. The longitudinal flow channels 232 are formed with two water outlet holes 234 at a bottom portion of the water-outlet base 20. A sealing washer 24 is plugged and fixed at each of the water outlet holes 234, such that the water flow from the water inlet hole 233 is turned by an angle of about 90° through the lateral flow channel 231 and the longitudinal flow channels 232. In addition, the water-outlet base 20 is formed with two inner annular walls 25 at the bottom portion thereof. A plurality of positioning tooth slots 251 extended in a longitudinal direction is arranged on one of the inner annular walls 25 in a circumferential direction. Meanwhile, a positioning axle hole 26 is provided at a center of the bottom portion of the water-outlet base 20. Furthermore, the water-outlet base 20 is provided with a cone-shaped step portion 27 at a proper position on the outer peripheral wall thereof, so as to form a stopping annular wall 28 thereon.

The rotary member 30 mainly includes an outlet valve 301, an operation frame 302, and a face cover portion 303. The outlet valve 301 is formed by an upper cover 31, a middle cover 32, and a lower cover 33 firmly joined together. The face cover portion 303 is constituted by a first face cover 35 and a second face cover 36.

Figure 8:
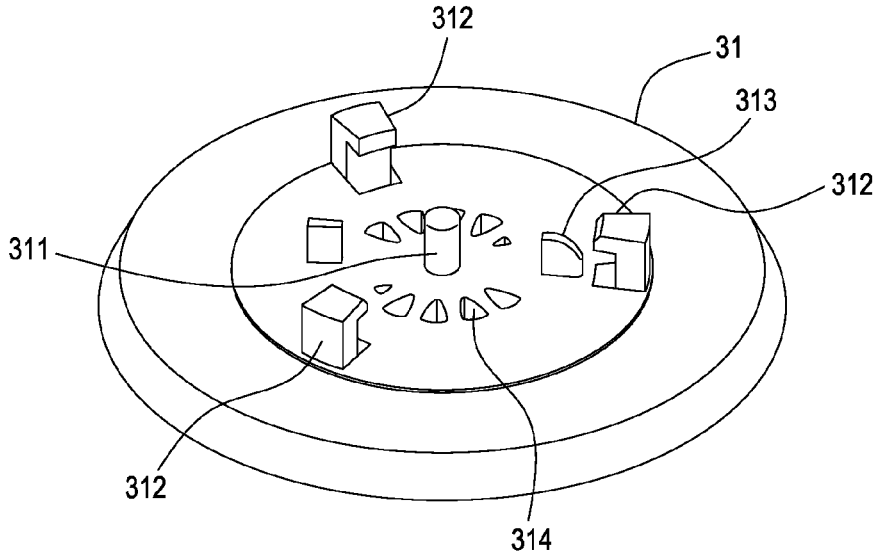
FIG. 8 is a stereogram of an appearance of a top portion of a water-outlet base according to the present invention.
Figure 9:
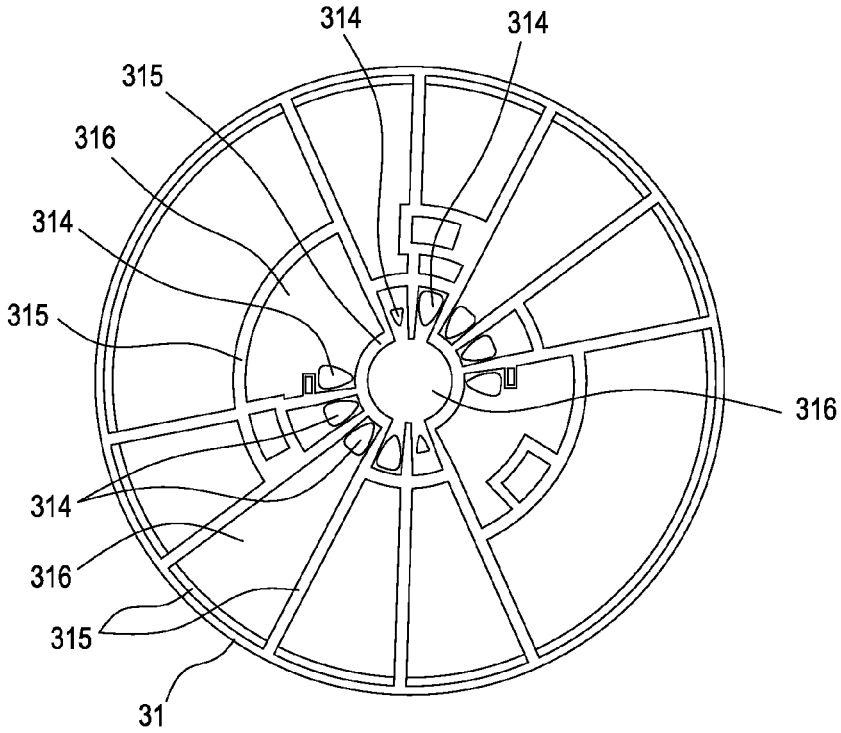
FIG. 9 is a plan view of a bottom portion of an upper cover according to the present invention.
Figure 10:
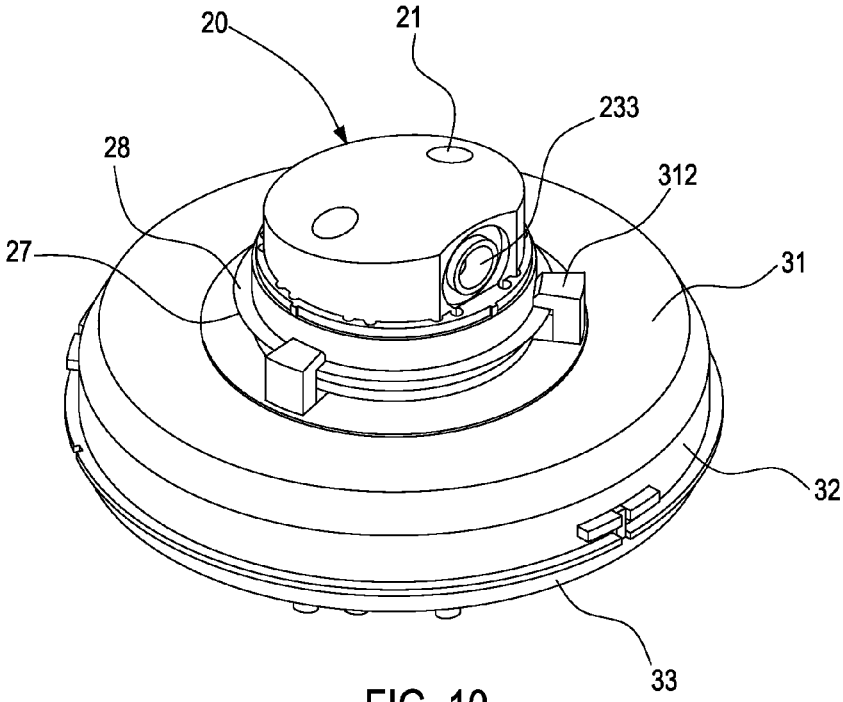
FIG. 10 is an assembled view of an appearance of a water-outlet base and a outlet valve according to the present invention.

Referring to FIGS. 8 to 10, in this embodiment, a positioning axle post 311 is protruded from a center of a top wall of the upper cover 31, which can be inserted into and pivoted to the positioning axle hole 26 on the bottom portion of the water-outlet base 20. Three positioning hooks 312 are equiangularly protruded around the top wall of the upper cover 31 and fastened and restricted by the stopping annular wall 28 of the water-outlet base 20, so that the upper cover 31 is restricted on the water-outlet base 20 in a longitudinal direction and rotates with respect to the water-outlet base 20. In addition, a positioning tooth 313 is protruded from an inner side of one of the positioning hooks 312 on the top wall of the upper cover 31 and properly engaged with any of the positioning tooth slots 251 on the inner annular walls 25 at the bottom portion of the water-outlet base 20, so that the upper cover 31 is rotatably fastened and restricted at a proper circumferential position. Furthermore, a plurality of holes 314 with different sizes for the water flow to pass therethrough is distributed at a middle portion of the top wall of the upper cover 31 in a circumferential direction. A bottom wall of the upper cover 31 is formed with a plurality of partitioning ribs 315 with proper shapes, so as to define a plurality of areas 316. The holes 314 are properly located within the areas 316.

Figure 5:
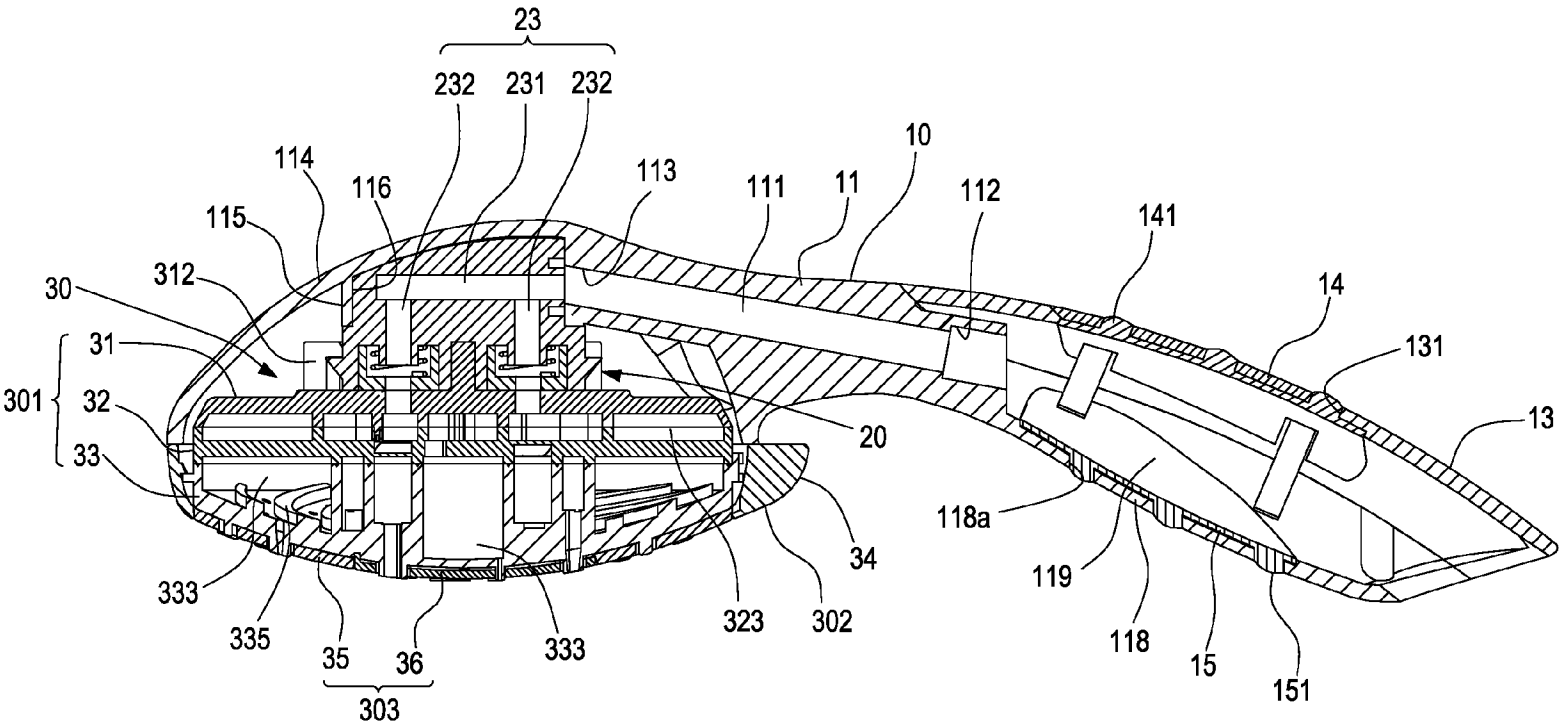
FIG. 5 is a partial cross-sectional side view of a hand-held showerhead structure according to the present invention.
Figure 11:
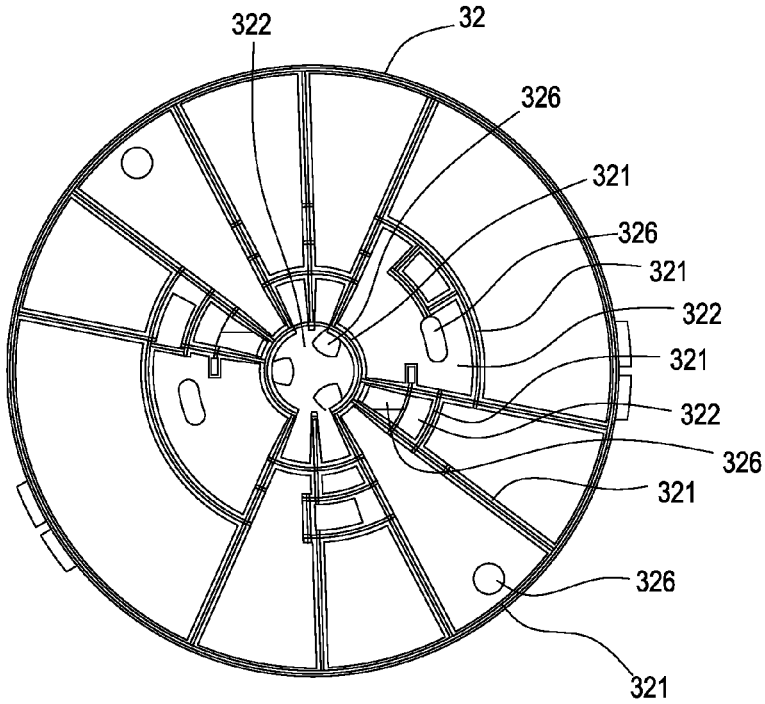
FIG. 11 is a plan view of a top portion of a middle cover according to the present invention.
Figure 12:
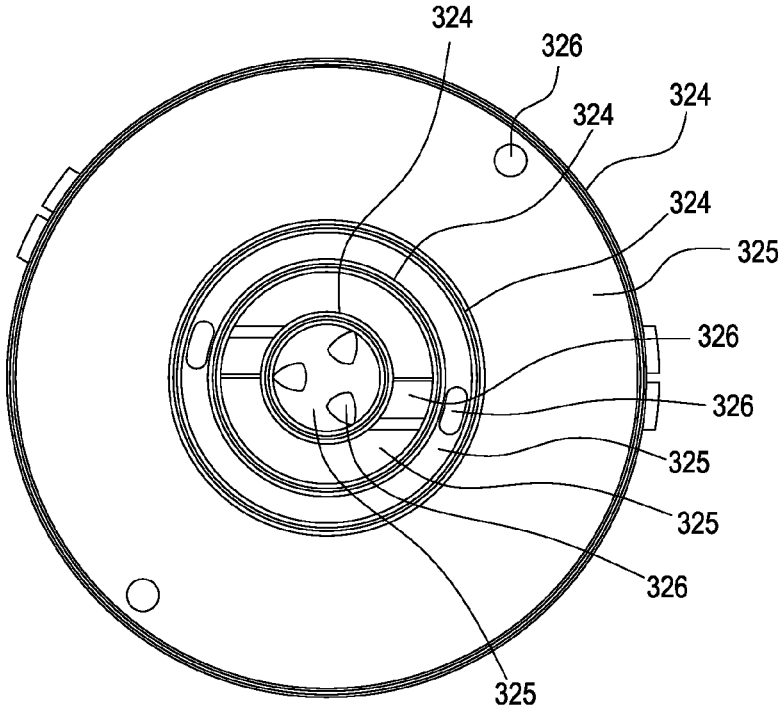
FIG. 12 is a plan view of a bottom portion of a middle cover according to the present invention.

Referring to FIGS. 11 and 12, the middle cover 32 is adhered to the bottom portion of the upper cover 31 and is formed with a plurality of partitioning ribs 321 with proper shapes on a top wall thereof, and a plurality of areas 322 is defined by the partitioning ribs 321. The partitioning ribs 321 can also be joined with the opposing partitioning ribs 315 on the bottom wall of the upper cover 31, so as to define a plurality of grid-shaped chambers 323 as shown in FIG. 5. In addition, the middle cover 32 is formed with four concentric annular partitioning ribs 324 on a bottom wall thereof, which can define four annular areas 325. Furthermore, at least one hole 326 with a proper shape for the water flow to pass therethrough is provided at each of the annular area 325 on the bottom wall of the middle cover 32. The holes 326 are just located within the proper areas 322 on the top wall of the middle cover 32. Meanwhile, the holes 326 in the outermost annular areas 325 on the bottom wall of the middle cover 32 may be set as inclined holes.

Figure 13:
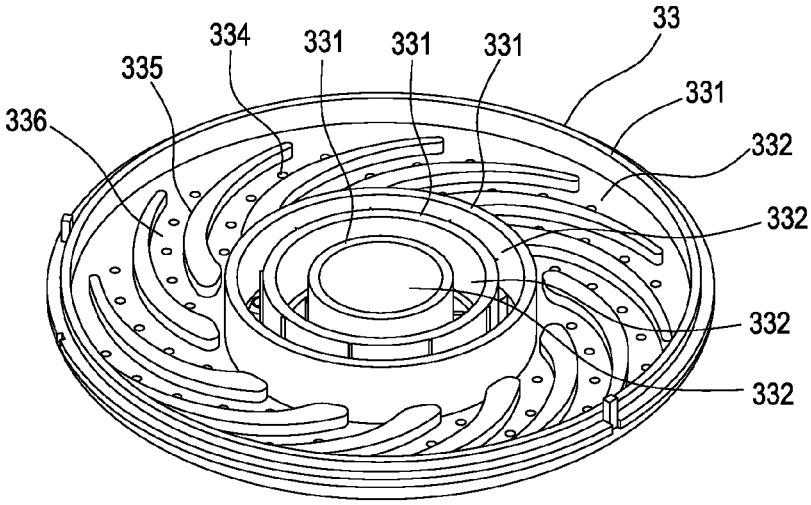
FIG. 13 is a stereogram of an appearance of a top portion of a lower cover according to the present invention.
Figure 14:
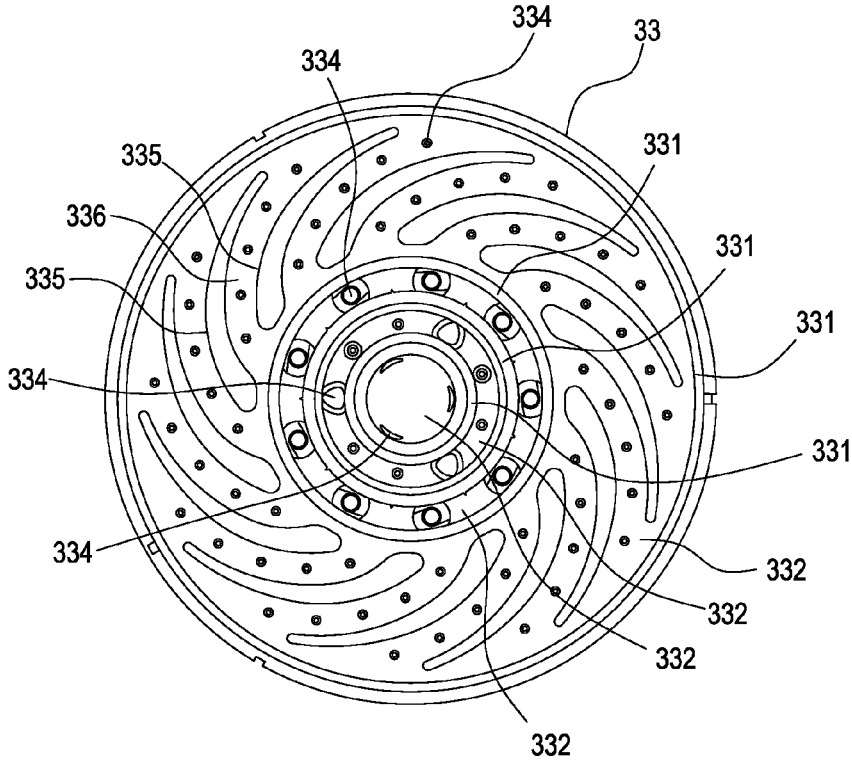
FIG. 14 is a plan view of a top portion of a lower cover according to the present invention.
Figure 15:
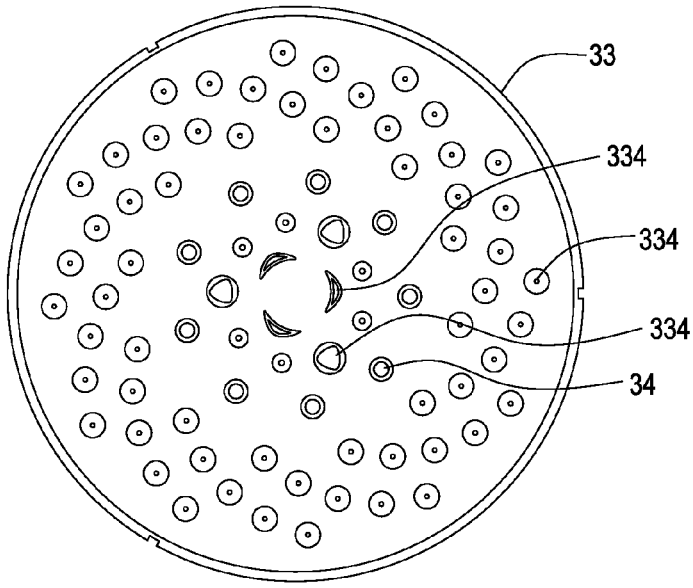
FIG. 15 is a plan view of a bottom portion of a lower cover according to the present invention.

Referring to FIGS. 13 to 15, the lower cover 33 is adhered to the bottom portion of the middle cover 32, and is formed with four concentric annular partitioning ribs 331 on a top wall thereof, in which four annular areas 332 are defined by the four concentric annular partitioning ribs 331. The partitioning ribs 331 can also be joined with the opposing annular partitioning ribs 324 on the bottom wall of the middle cover 32, so as to define a plurality of annular chambers 333, as shown in FIG. 5. Meanwhile, a plurality of properly-distributed holes 334 with proper shapes for the water flow to pass therethrough is provided at the annular areas 332 on the top wall of the lower cover 33. It should be particularly noted that, compared with the other annular chambers 333, the outermost annular chamber 333 has a larger radial width, and a plurality of arc-shaped flow-guiding ribs 335 distributed radially and separated from one another is protruded from a top wall within the annular chamber 333. An open-ended arc-shaped flow-guiding channel 336 is defined between any two adjacent flow-guiding ribs 335. Meanwhile, the holes 334 on the lower cover 33 are respectively arranged and distributed along the flow-guiding directions of the flow-guiding channels 336 in sequence.

The operation frame 302 is engaged around the lower cover 33. A plurality of protrusions 34 is provided around the operation frame 302, which is convenient for the user to exert a rotary force to drive the lower cover 33.

The first face cover 35 is overlapped and adhered at a peripheral area of the bottom wall of the lower cover 33, and is provided with a plurality of though-holes 351 thereon. The though-holes 351 can be made corresponding to the holes 334 on the lower cover 33.

The second face cover 36 is overlapped and adhered at a central area of a bottom wall of the first face cover 35, and is provided with a plurality of though-holes 361 thereon. The though-holes 361 can be made corresponding to the though-holes 351 on the first face cover 35.

Figure 16:
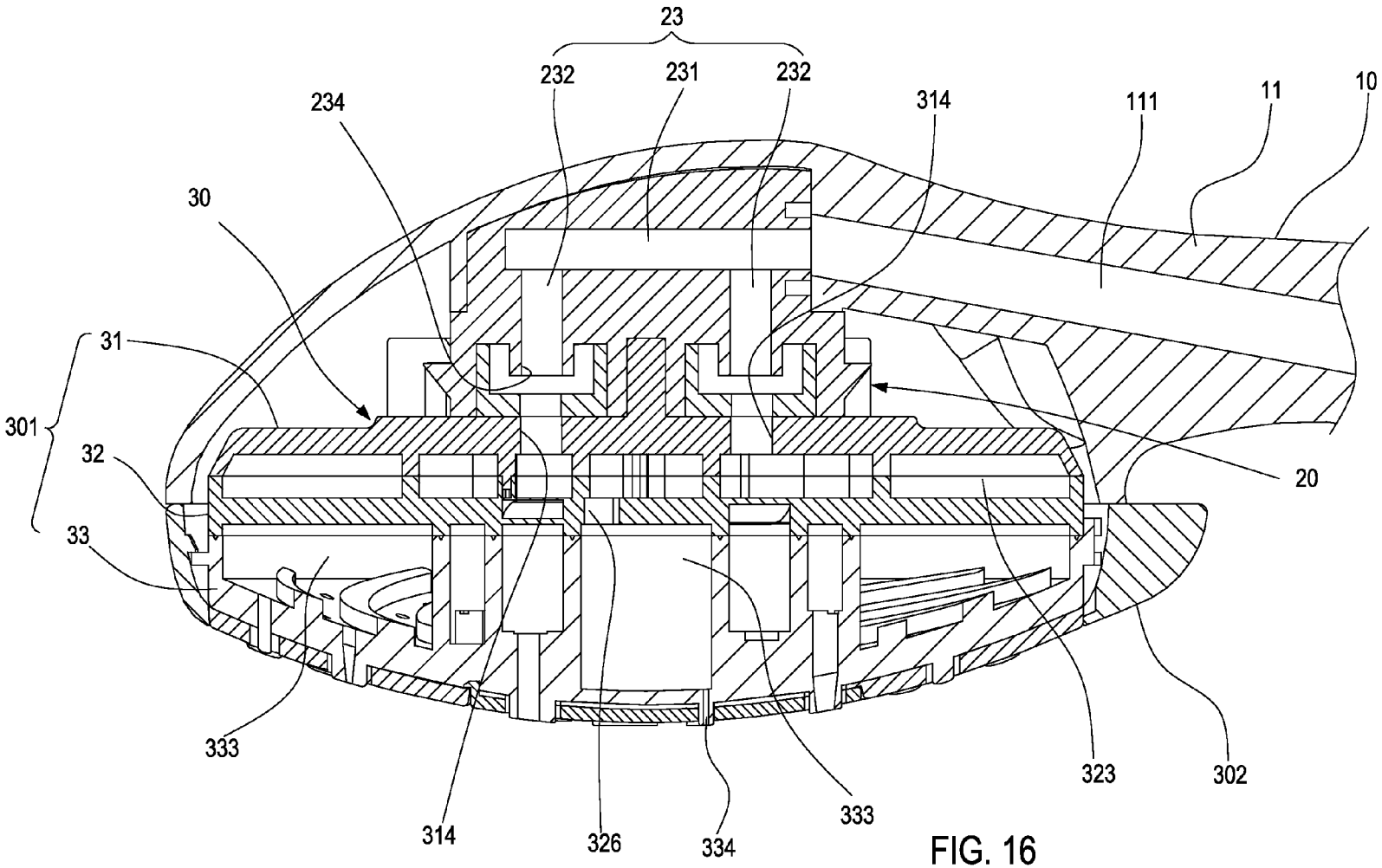
FIG. 16 is a partially cross-sectional enlarged view of the present invention.
Figure 17:
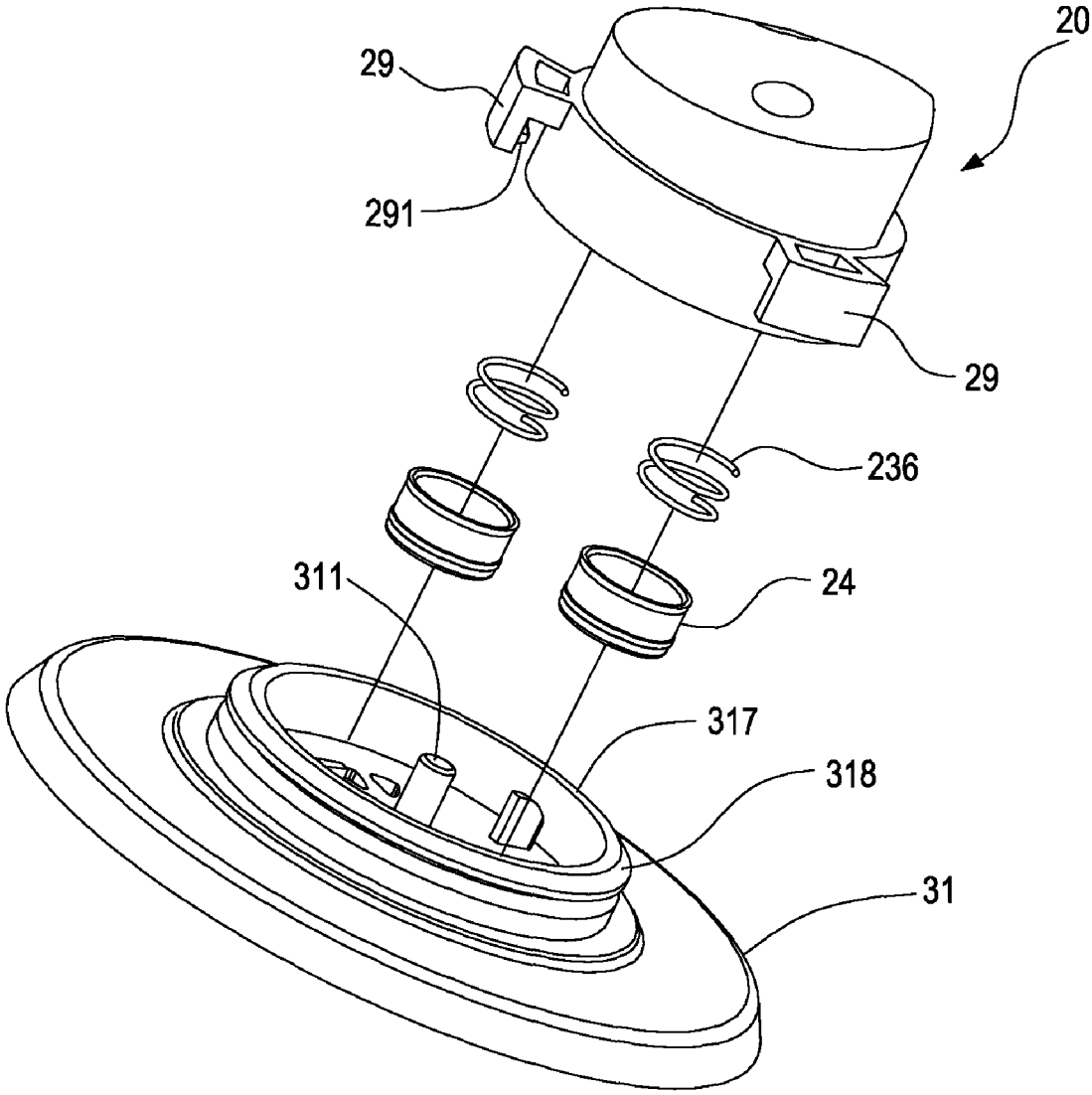
FIG. 17 is an exploded stereogram of a water-outlet base and an upper cover according to another embodiment of the present invention.
Figure 18:
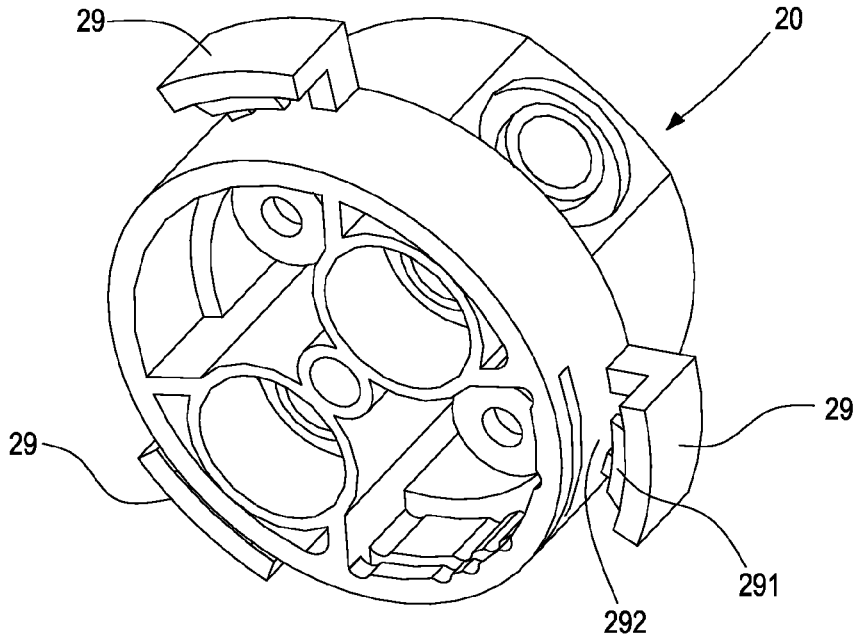
FIG. 18 is a stereogram of an appearance of a water-outlet base according to another embodiment of the present invention.
Figure 19:
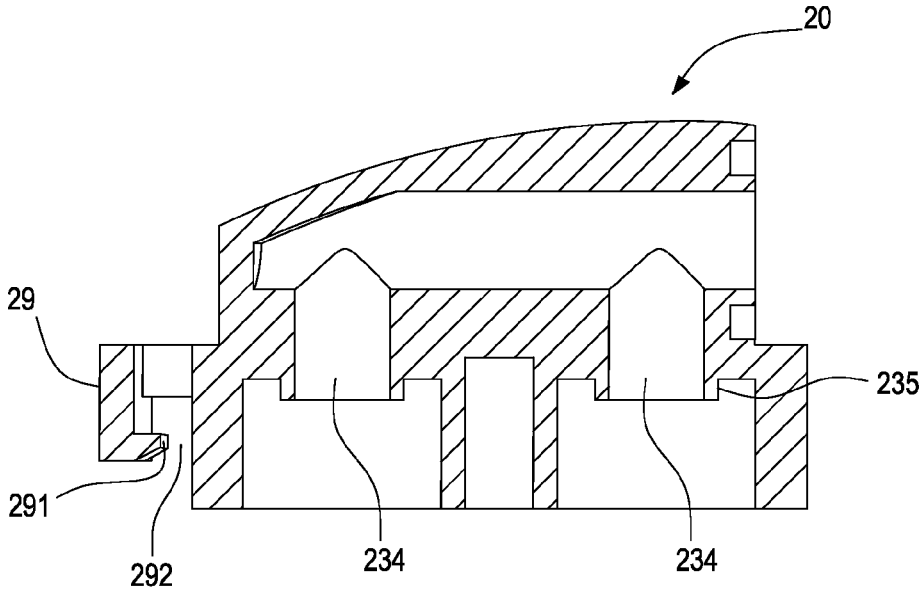
FIG. 19 is a cross-sectional side view of a water-outlet base according to another embodiment of the present invention.
Figure 20:
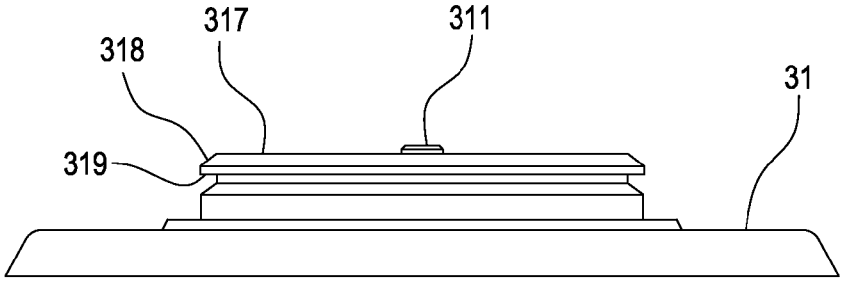
FIG. 20 is a side plan view of an upper cover according to another embodiment of the present invention.

FIG. 16 is a partially cross-sectional enlarged view of a hand-held showerhead structure according to the present invention. Referring to FIG. 16, when a user turns on a switch, a water flow enters the pipe fitting from the connection pipe and then flows through the water flow channel 111 of the handle body 11 and the water flow channel 23 of the water-outlet base 20 sequentially to reach the rotary member 30, as shown in FIG. 7. Since the whole rotary member 30 can be rotationally adjusted properly, when the proper holes 314 on the upper cover 31 of the outlet valve 301 in the rotary member 30 are aligned with the water outlet holes 234 on the bottom portion of the water-outlet base 20, the water flow enters a corresponding grid-shaped chamber 323 between the upper cover 31 and the middle cover 32 via the corresponding holes 314, then passes through the hole 326 on the top wall of the middle cover 32 opposing to the grid-shaped chamber 323 to enter a corresponding annular chamber 333 between the middle cover 32 and the lower cover 33, and finally, the water is sprayed out via the holes 334 of the lower cover 33, thereby achieving a water-spraying effect of a predefined mode. Definitely, when the user uses the showerhead, he/she can adjust the water-spraying modes at any time according to personal requirements. In operation, the user holds the handle portion 10 with one hand, and rotates the operation frame 302 with the other hand, so as to easily rotate the whole rotary member 30. During the operation, the positioning tooth 313 on the top wall of the upper cover 31 can be fastened and engaged with the corresponding positioning tooth slots 251 on the bottom portion of the water-outlet base 20 as shown in FIGS. 6 and 8, so as to rotationally position the upper cover 31 in a desired water-spraying mode accurately. At this time, since positions of the holes 314 on the upper cover 31 corresponding to the water outlet holes 234 of the water-outlet base 20 are changed, the water-spraying mode generated by the water flow after passing through the outlet valve 301 is changed accordingly, thereby achieving a function of adjusting the water-spraying modes freely.

Besides the above combining configuration of the water-outlet base and the upper cover in the above preferred embodiment, the water-outlet base and the upper cover of the present invention may also be combined in another manner according to another embodiment. Referring to FIGS. 17 to 20, the water-outlet base 20 and the upper cover 31 are substantially the same as those of the above preferred embodiment, but the differences there-between lie in that: the position of the positioning hooks 312 and that of the stopping annular wall 28 in the above preferred embodiment are exchanged in this embodiment. Particularly, three positioning hooks 29 are equiangularly extended downward from the outer peripheral wall of the water-outlet base 20, and sufficient large inserting spaces 292 are formed between the end portions 291 of the positioning hooks 29 and the outer peripheral wall. In addition, an annular wall 317 is protruded upward around the top wall of the upper cover 31. The annular wall 317 is formed with a guide inclined plane 318 at a top end thereof and is formed with a step portion on an outer peripheral wall thereof. A stopping annular wall 319 facing downward is formed on the step portion. In this manner, upon being guided by the guide inclined plane 318, the annular wall 317 of the upper cover 31 can smoothly slide upward into the inserting spaces 292 formed between the end portions 291 of the positioning hooks 29 and the outer peripheral wall of the water-outlet base 20, thereby enabling the stopping annular wall 319 facing downward to be fastened and restricted by the end portions 291 of the positioning hooks 29. Therefore, the upper cover 31 is restricted to make relative rotation on the water-outlet base 20 in a longitudinal direction. In addition, in order to maintain a steady fastening and positioning state between the water-outlet base 20 and the upper cover 31, without loosening or shaking due to an assembled clearance, positioning flanges 235 are formed at the water outlet holes 234 of the water-outlet base 20 respectively, which are provided for positioning the resilient elements 236 that may be compression springs. Then, the sealing washers 24 are plugged and fixed into the water outlet holes 234, such that the sealing washers 24 are respectively affected by the restoring forces of the corresponding resilient elements 236, and thus resiliently pressed against the top wall of the upper cover 31. Therefore, a resilient fastening state is maintained between the water-outlet base 20 and the upper cover 31, which enables the rotary member 30 to be rotationally adjusted stably, without loosening and shaking phenomena.

Figure 21:
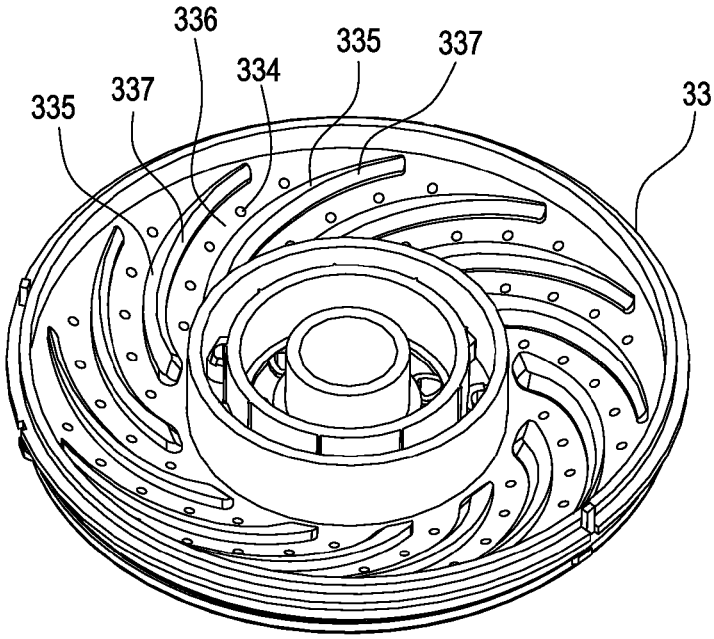
FIG. 21 is a stereogram of an appearance of a lower cover according to another embodiment of the present invention.

According to another embodiment of the present invention, the middle cover 32 and the lower cover 33 are substantially the same as that in the above preferred embodiment, and the differences there-between mainly lie in that: an inclination angle of the holes 326 on the middle cover 32 opposing to the outermost annular chamber 333 may be substantially consistent with the flow-guiding directions of the flow-guiding channels 336 (not shown). In addition, inner side walls 337 of the flow-guiding ribs 335 of the lower cover 33 may be set as inclined as shown in FIG. 21. Therefore, the water flow passing through the holes 326 and the flow-guiding channels 336 can be properly guided, so as to enhance the flowing rate and communication of the water flows, thereby further improving the water-spraying intensity and the uniformity.

In view of the above illustrations, the features and efficacies of the hand-held showerhead structure of the present invention are summarized as follows.

1. In the present invention, the annular chamber 333 defined between the middle cover 32 and the lower cover 33 is set to have a relatively large radial width, such that when the mode of the hand-held showerhead structure is adjusted and positioned in such a way that the water is output via the annular chamber 333, the water-spraying range and area are greatly enlarged through a large annular water outlet area and a plurality of widely-distributed water outlet holes 334. Therefore, the annular chamber 333 with a large radial width is preferably set in the outermost peripheral area, which is not limited thereby, but may also be set in other areas.

2. In the present invention, besides utilizing the above annular chamber 333 with a relatively large radial width to enlarge the water-spraying range, a uniform distribution of the sprayed water within the water-spraying range can be ensured through the distribution design of the arc-shaped flow-guiding ribs 335, the arc-shaped flow-guiding channels 336, and the holes 334 on the top wall of the lower cover 33. Particularly, since the arc-shaped flow-guiding ribs 335 are radially distributed and separated from each other, an open-ended arc-shaped flow-guiding channel 336 is defined between any two adjacent flow-guiding ribs 335, and thus, a radial flow-guiding effect can be obtained by the radial-shaped design of the arc-shaped flow-guiding ribs 335, which enables the water flow to quickly and smoothly pass through each of the flow-guiding channels 336. In addition, the open-ended design of the flow-guiding channels 336 enables a portion of the water flow to be communicated within the flow-guiding channels 336, which facilitates the uniform distribution of the water flow. Moreover, the holes 334 of the lower cover 33 are respectively arranged and distributed along the flow-guiding directions of the flow-guiding channels 336 in sequence. Therefore, the water flow guided by the flow-guiding ribs 335 and quickly flowing within the flow-guiding channels 336 can be uniformly and quickly sprayed out via the holes 334, thereby achieving a uniform spraying effect. What's more, in the present invention, the inclination angle of the holes 334 of the middle cover 32 opposing to the annular chamber 333 is designed as substantially consistent with the flow-guiding directions of the flow-guiding channels 336, and the inner side walls 337 of the flow-guiding ribs 335 are designed as inclined walls, which are all helpful for the quick guiding and communication of the water flow, thereby improving the water-spraying intensity and uniformity.

3. In the present invention, the rotary member 30 provides rotational positioning of the water-spraying modes mainly through utilizing the engagement between the positioning tooth 313 on the top wall of the upper cover 31 and the corresponding positioning tooth slots 251 on the inner annular walls 25 at the bottom portion of the water-outlet base 20. With such a structural design, since the engagement in a circumferential direction is adopted, even if there is a slight longitudinal displacement between the upper cover 31 and the water-outlet base 20 due to a water pressure there-between, the positioning tooth 313 and the positioning tooth slots 251 can still maintain the engagement state without detaching from each other. Therefore, the user can also smoothly and correctly adjust the water-spraying modes in the water out state.

4. According to another embodiment of the present invention, the upper cover is firmly restricted in a longitudinal direction through the engagement between the stopping annular wall 319 thereon and the positioning hooks 29 of the water-outlet base 20. Moreover, the stopping annular wall 319 of the upper cover and the positioning hooks 29 of the water-outlet base 20 can maintain a resilient fastening state through the resilient elements 236 there-between. Such a resilient fastening state enables the whole rotary member 30 to be rotationally adjusted stably, without the loosening or shaking phenomena.

5. The handle portion 10 of the present invention is constituted by the pipe fitting 12, the upper handle cover 13, the upper anti-slip plate 14, and the lower anti-slip plate 15 mounted at the lower handle cover 118 of the handle body 11. With such a structure, since the pipe fitting 12 is a separate member, it can be easily molded. Therefore, the yield of the product is increased. Secondly, since the upper anti-slip plate 14 and the lower anti-slip plate 15 are tightly clamped between the corresponding upper handle cover 13 and the pipe fitting 12 and between the pipe fitting 12 and the lower handle cover 118 of the handle body 11, the joining strength is increased, thereby achieving a desirable anti-slip effect.

To sum up, the present invention meets the inventiveness requirements among similar products. Furthermore, not only the specific constructions disclosed never appeared in the products of the same kind, but also have never been published at home and abroad before the instant application. Therefore, the present application meets the requirements of a utility model patent, and thus the present application is filed for a patent according to the law.

The foregoing is merely intended to illustrate preferred embodiments of the present invention. It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A hand-held showerhead structure, comprising:

a handle portion, comprising a water inlet end and a water outlet end, for guiding a water flow from the water inlet end to the water outlet end;

a water-outlet base, mounted and fixed at the water outlet end of the handle portion, for guiding and changing a direction of the water flow; and a rotary member, comprising an outlet valve formed by an upper cover, a middle cover, and a lower cover firmly joined to one another, a plurality of predetermined grid-shaped chambers being defined between the upper cover and the middle cover, a plurality of predetermined annular chambers being defined between the middle cover and the lower cover, a plurality of holes for being communicated with the predetermined grid-shaped and predetermined annular chambers being respectively provided at predetermined positions of the upper cover, the middle cover, and the lower cover, the upper cover being movably fastened on the water-outlet base and rotated on the water-outlet base together with the middle cover and the lower cover, the water flow from the water-outlet base sequentially passing through the predetermined holes of the upper cover, the predetermined grid-shaped chambers between the upper cover and the middle cover, the predetermined holes of the middle cover, the predetermined annular chambers between the middle cover and the lower cover, and the predetermined holes of the lower cover, and then being sprayed out in a form of a predetermined water-spraying mode;

wherein a plurality of arc-shaped flow-guide ribs distributed radially and separated from one another is protruded from a top wall of the lower cover opposing to one of the predetermined annular chambers, an open-ended arc-shaped flow-guide channel is defined between any two adjacent flow-guide ribs, and the predetermined holes of on the lower cover are sequentially arranged and distributed along flow-guiding directions of the flow-guide channels respectively.

2. The hand-held showerhead structure according to claim 1, wherein the annular chamber opposing to the flow-guide ribs of the lower cover is preferably adjacent to an outer peripheral area.

3. The hand-held showerhead structure according to claim 1, wherein the rotary member further comprises an operation frame, engaged around the lower cover.

4. The hand-held showerhead structure according to claim 1, wherein the rotary member further comprises a face cover portion, for overlapping a bottom wall of the lower cover.

5. The hand-held showerhead structure according to claim 1, wherein the predetermined holes of the middle cover opposing to the chamber containing the flow-guide ribs are set as inclined holes with inclination angles approximately consistent with the flow-guiding directions of the flow-guide channels.

6. The hand-held showerhead structure according to claim 1, wherein inner walls of the flow-guide ribs are inclined.

7. The hand-held showerhead structure according to claim 1, wherein the upper cover is provided with a positioning tooth protruded from a top wall thereof, the water-outlet base is provided with an inner annular wall at a bottom portion thereof, and the inner annular wall is provided with a plurality of positioning tooth slots for being properly engaged with the positioning tooth, so as to allow the rotary member to be rotationally adjusted and positioned.

8. The hand-held showerhead structure according to claim 1, wherein the water-outlet base is provided with a positioning axle hole at a center of a bottom portion thereof, and further provided with a step portion on an outer peripheral wall thereof, and the step portion is provided with a stopping annular wall facing upward, the upper cover is provided with a positioning axle post extended from a center of a top wall thereof, for being inserted and pivoted to the positioning axle hole on the bottom portion of the water-outlet base, and the upper cover is further provided with a plurality of positioning hooks equiangularly protruded around the top wall thereof to be fastened and restricted by the stopping annular wall of the water-outlet base, so as to restrict the upper cover to make relative rotation on the water-outlet base in a longitudinal direction.

9. The hand-held showerhead structure according to claim 1, wherein the water-outlet base is provided with a positioning axle hole at a center of a bottom portion thereof, and further provided with a plurality of positioning hooks equiangularly extended downward from an outer peripheral wall thereof, the upper cover is provided with a positioning axle post extended from a center of a top wall thereof to be inserted and pivoted to the positioning axle hole on the bottom portion of the water-outlet base, and the upper cover is further provided with an annular wall protruded upward around the top wall, and the annular wall is provided with a step portion on an outer peripheral wall thereof, and the step portion is formed with a stopping annular wall facing downward to be fastened and restricted by the positioning hooks of the water-outlet base, so as to restrict the upper cover to make relative rotation on the water-outlet base in a longitudinal direction.

10. The hand-held showerhead structure according to claim 9, wherein the water-outlet base is further provided with two outlet holes at the bottom portion thereof, each of the outlet holes is plugged and fixed with a sealing washer, and between each of the outlet holes and each of the sealing washers, a resilient element is further disposed for resiliently pressing the sealing washers against a wall surface opposite to a top wall of the upper cover, so as to maintain a resilient fastening state between the water-outlet base and the upper cover.

11. The hand-held showerhead structure according to claim 1, wherein the handle portion further comprises a handle body, a pipe fitting, an upper handle cover, an upper anti-slip plate, and a lower anti-slip plate, the handle body being provided with the water outlet end and integrally formed with a lower handle cover extended from the water inlet end, an accommodating groove being provided above the lower handle cover for the pipe fitting to be mounted therein, the upper handle cover being used to cover the accommodating groove, the upper anti-slip plate being clamped between the upper handle cover and the pipe fitting and being properly protruded from the upper handle cover, so as to form an upper anti-slip rib, and the lower anti-slip plate being clamped between the pipe fitting and the lower handle cover and being properly protruded from the lower handle cover, so as to form a lower anti-slip rib.

12. The hand-held showerhead structure according to claim 11, wherein the pipe fitting is respectively provided with a water outlet joint and a water inlet joint at a front end and a rear end thereof, and a pipe connection hole being provided at the handle body close to the lower handle cover for the water outlet joint of the pipe fitting to be inserted and fixed therein.

* * * * *